United States Patent [19]

Helm et al.

[11] 4,449,635

[45] May 22, 1984

[54] IMAGINARY PIVOT LIFT CRANE

[75] Inventors: Percy R. Helm; James G. Morrow, Sr., both of Manitowoc, Wis.

[73] Assignee: The Manitowoc Company, Inc., Manitowoc, Wis.

[21] Appl. No.: 404,435

[22] Filed: Aug. 2, 1982

Related U.S. Application Data

[63] Continuation-in-part of Ser. No. 128,139, Mar. 7, 1980, Pat. No. 4,358,021.

[51] Int. Cl.[3] ..... B66C 23/74

[52] U.S. Cl. ..... 212/196; 212/189; 212/232

[58] Field of Search ..... 212/195, 196, 175, 182, 212/232, 198, 189, 223; 180/9.1, 9.48

[56] References Cited

U.S. PATENT DOCUMENTS

| | | | |
|---|---|---|---|
| 3,836,010 | 9/1974 | Lampson | 212/195 |
| 3,930,583 | 1/1976 | Jouffray | 212/195 |
| 4,170,309 | 10/1979 | Lampson | 212/198 |
| 4,243,148 | 1/1981 | Lampson | 212/196 |

FOREIGN PATENT DOCUMENTS

| | | |
|---|---|---|
| 1203920 | 9/1970 | United Kingdom . |
| 1466686 | 3/1977 | United Kingdom . |
| 2050795 | 1/1981 | United Kingdom . |
| 2053147 | 2/1981 | United Kingdom . |
| 2053146 | 2/1981 | United Kingdom . |

*Primary Examiner*—Trygve M. Blix
*Assistant Examiner*—Stephen P. Avila
*Attorney, Agent, or Firm*—Leydig, Voit, Osann, Mayer & Holt, Ltd.

[57] ABSTRACT

A lift crane having a separated transporter-supported front ring segment and a transporter-supported rear works including a counterweight. The front ring segment is connected by a frame element to the rear works and supports a carrier which pivotally mounts a forwardly-inclined boom and a rearwardly-inclined mast. Movement of the carrier across the front ring segment is permitted by two equal-length links pivotally connected to opposite sides of the carrier and the respective opposite sides of a horizontal bracket mounted on the frame element. The center of rotation of the carrier as it traverses the front ring segment is substantially coincident with the imaginary vertex of a truncated isosceles triangle formed by the carrier and lines running axially along the links. When the carrier is centered on the front ring segment, the center of rotation is also substantially coincident with a vertical axis running through the rearward-most point of the mast. Since the rearwardmost point of the mast is substantially coincident with the center of rotation, this point of the mast remains substantially stationary during the movement of the carrier across the front ring segment. A fixed length pendant connecting the rearwardmost point of the mast to the rear works also remains substantially stationary and in a vertical plane during the movement of the carrier across the ring segment, thus minimizing the amount of side loads and torsional forces induced in the mast due to such carrier movement.

5 Claims, 6 Drawing Figures

IMAGINARY PIVOT LIFT CRANE

This application is a continuation-in-part of our copending application Ser. No. 128,139, filed Mar. 7, 1980, now U.S. Pat. No. 4,358,021.

TECHNICAL FIELD

This invention relates generally to lift cranes and, more particularly, concerns a large mobile, segmented crane.

BACKGROUND ART

In response to ever-increasing user needs, self-propelled cranes have been made capable of lifting ever greater loads. While a number of factors enter into determining crane capacity, a basic limitation arises from the fact that, inevitably, the weight of the crane and its load must be transferred to the earth in some stable fashion and, if rotation of the load is desired, the crane/earth connection must be made stable throughout the arc of crane rotation.

A significant increase in crane capacity was achieved by providing a self-propelled crane with the support ring and extended boom carrier disclosed and claimed in U.S. Pat. Nos. 3,485,383 and 3,878,944. In these designs, the weight of the crane and its load is transferred to the ground through a large diameter, track-like ring. As shown in these patents, and as practiced commercially for some years, the support ring is either blocked into place by timbers fitted and wedged beneath and completely around the ring or is supported by a plurality of jacks spaced around the periphery of the ring.

Further refinements in ring supported cranes are disclosed in U.S. Pat. Nos. 4,042,115 and 4,103,783. These patents disclose, inter alia, that a separate transporter mechanism may be run in and out of an otherwise stationary ring-supported crane in order to move that crane between different locations. Alternatively, transporter mechanisms and/or idler crawlers or dollies may be installed beneath the ring under the boom foot and counterweight.

The stability of the earth-crane connection was significantly improved by the crane disclosed in copending parent application Ser. No. 128,139, now U.S. Pat. No. 4,358,021. This application discloses a lift crane having its counterweight mounted on a rear, ring-supported rotatable deck. A front ring segment supports a boom carrier on which a forwardly inclined boom and a rearwardly inclined mast are pivotally mounted. The tip of the mast, the tip of the boom and the counterweight are interconnected by rigging with a swivel connection between the mast tip and the counterweight. The carrier is mounted on rollers for movement on the front ring segment and, as the carrier pivots about a first vertical axis intermediate of the boom carrier and the rear ring, the counterweight pivots about a second vertical axis running through the center of the rear ring. Due to this crane's ability to move a load through a limited arc without having to activate its transporter assemblies, it has been found to be particularly useful in accurately placing a heavy load on mounting blocks, bolts or the like.

While the dual pivot crane of copending application Ser. No. 128,139, now U.S. Pat. No. 4,358,021 constitutes a significant improvement in traveling lift cranes, it was determined that the load capacity of this type of crane is limited by the fact that side loads are induced in the rearwardly inclined mast when the crane is pivoted due to the tip of the mast and the point on the rear deck to which the mast tip is connected by rigging moving out of alignment when viewed from above. (When aligned, the mast is subjected to substantially no side loads.) Thus, the primary object of the present invention is to provide a heavy lift crane assembly having a separated front ring segment with a boom and mast mounted on a boom carrier for rotation on the ring segment spaced outwardly from the rear works in which the torsional and side loads induced in the mast due to rotation of the carrier are minimized.

BRIEF DESCRIPTION OF DRAWINGS

Other objects and advantages of the invention will become apparent upon reading the following detailed description and upon reference to the drawings, in which.

DETAILED DESCRIPTION OF THE INVENTION

The present invention is generally directed to a segmented lift crane with a separated front ring segment and rear works. The rear works include a counterweight mounted on a rear rotatable deck supported by a rear transporter assembly. A front transporter assembly supports a partial ring segment in the form of a rotatable frame carrying a horizontal track, the rear works being connected to the rotatable frame by one or more frame elements. A carrier is mounted for movement on the horizontal track on which a forwardly inclined boom and rearwardly inclined mast are pivotally mounted, the boom and mast being pivoted for movement in a vertical plane. The tips of the boom and the mast are connected to the rear works by rigging.

Figure 1:
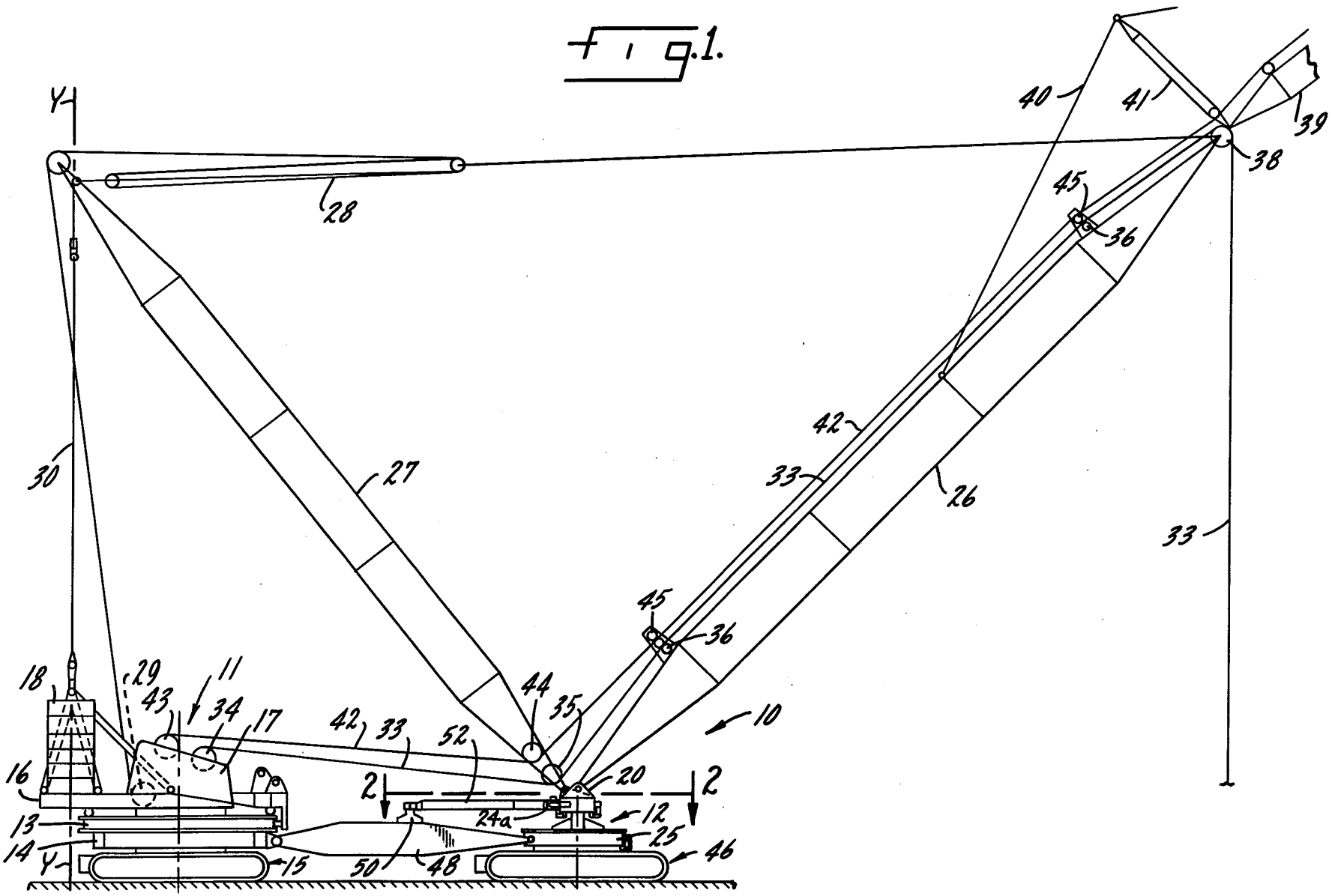
FIG. 1 is a side elevation of the lift crane of the present invention.

Turning now to the drawings, there is shown in FIG. 1 a ring supported lift crane 10 of the present invention. The crane 10 includes a rear machinery and counterweight support mechanism 11 and a front boom and mast support mechanism 12. In the illustrated crane, the machinery and counterweight support mechanism 11 includes a large diameter ring 13 supported by a substantially rectangular frame 14 on a self-propelled transporter mechanism 15. This aspect of the crane is substantially as disclosed in U.S. Pat. No. 4,195,740, which is hereby incorporated by reference. (The ring-like track 13 is on the order of 36 feet in diameter.) A rotatable deck 16 is provided to support lift machinery 17 and a counterweight 18.

The front boom and mast carrier mechanism 12 includes a carrier 20 supported by rollers 21 (best seen in FIG. 3) on a front ring segment or arcuate track 23, the ring segment being provided with a flange 24. Means for swinging the boom carrier 20 across the track 23 may be provided through hydraulic cylinders or by one or more independent swing drive mechanisms **24*a*** (shown in FIGS. 1 and 2) such as those shown in U.S.

Pat. Nos. 3,949,881 and 4,013,174, which are also incorporated herein by reference. The front ring segment 23 is preferably mounted on a rotatable frame 25, separated longitudinally from the rear ring 13. The carrier 20 pivotally mounts a forwardly inclined boom 26 and rearwardly inclined mast 27. The tip of the mast 27 is connected to the tip of the boom 26 by variable length rigging 28 which includes a multiple part line wound on a boom hoist drum 29 located on the machinery deck 16. The upper end of the mast 27 is also connected by means of a fixed length pendant 30 to the machinery deck 16. In this way, the counterweight 18 is connected to the mast tip and, through the rigging 28, the counterweight is applied to the boom tip to counteract the moment of a heavy load.

In the configuration shown in FIG. 1, the crane 10 includes a primary lift line 33 wound on a winch drum 34 and reeved around guide sheaves 35 and 36 and a boom tip sheave 38. The boom 26 is also provided with a jib section 39 supported by pendants 40 and a strut 41. An auxiliary lift line 42 is wound on another drum 43 and is guided by sheaves 44 and 45 to the tip (not shown) of the jib 39.

The front boom support mechanism 12 is carried on a transporter assembly 46 interconnected by a frame element 48 to the rear machinery transporter 15. The front transporter 46 is preferably a demountable self-propelled assembly such as that shown in U.S. Pat. Nos. 4,000,784 and 4,069,884, which are incorporated herein by reference. By suitably controlling the front transporter assembly 46 and the rear machinery transporter 15, the crane 10 may be moved over the terrain in either a loaded or unloaded condition.

Figure 4:
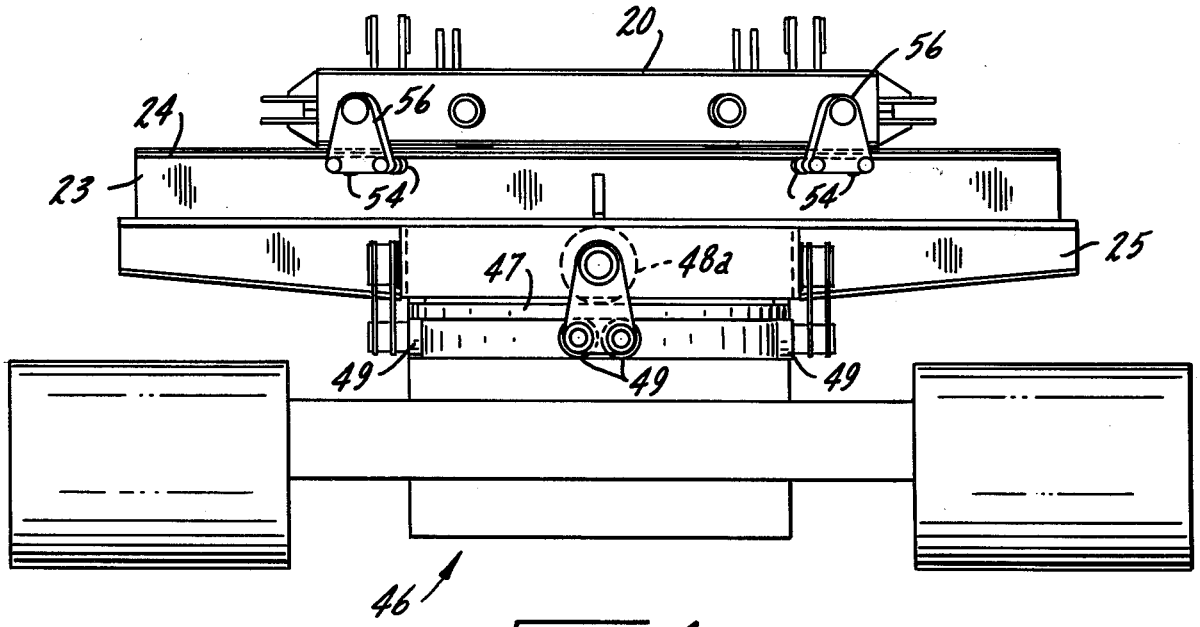
FIG. 4 is a front view showing the front transporter and boom carrier support works.

As shown in FIG. 4, the front transporter assembly 46 supports pivot ring 47 on which the rotatable frame 25 is mounted. The rotatable frame is mounted on the pivot ring by means of four equally spaced load rollers 48*a*, each connected to a pair of hook rollers 49 engaging the underside of the pivot ring. This permits the transporter mechanism 46 to be rotated beneath the frame 25 for propelling the front boom and mast support mechanism 12 in forward, reverse or turning directions.

Figure 3:
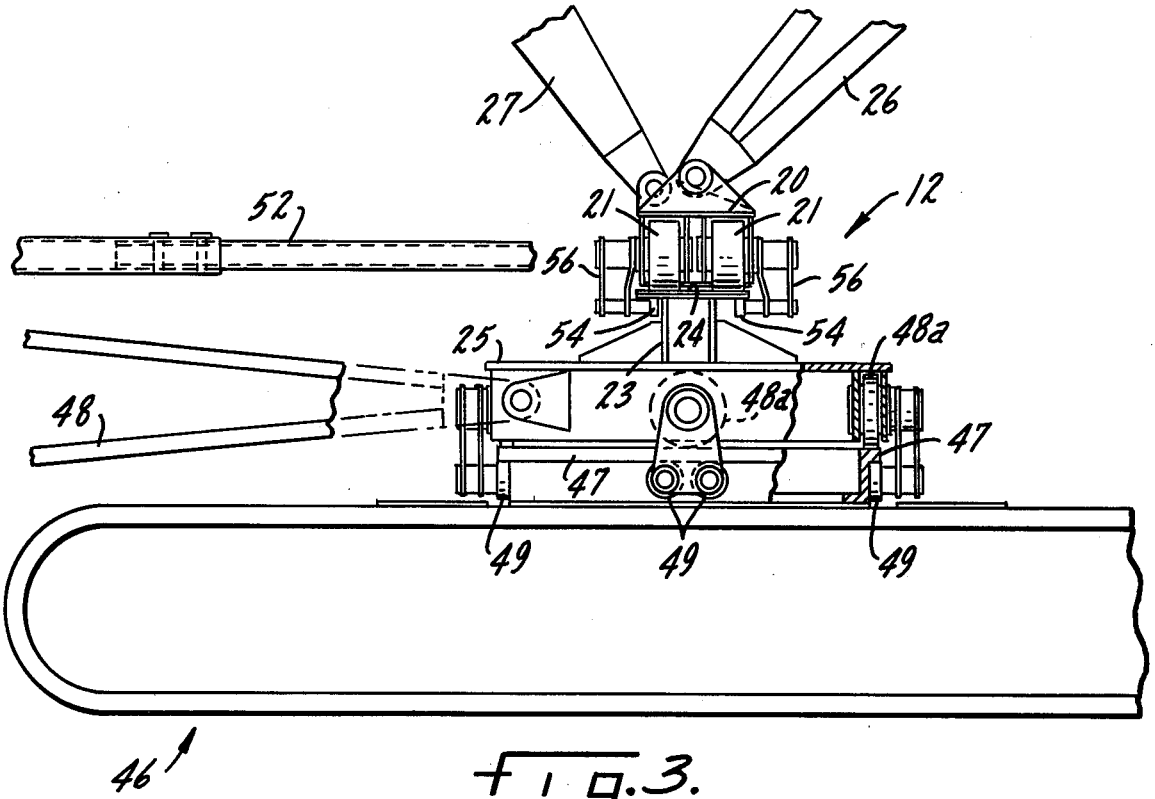
FIG. 3 is a fragmentary side view in partial section of the front transporter and boom carrier support works.

In the preferred embodiment, the carrier 20 is provided with four pairs of load rollers 21. As seen in FIG. 3, each pair is spaced in side-by-side relationship with their surfaces engaging the flange 24 and spaced along the carrier 20 with a pair of load rollers 21 at each end thereof. Each load roller of the pair of rollers mounted on the ends of the carrier has corresponding hook rollers 54 secured in spaced relationship to the load roller by a lug 56. The lug is spaced out on its side adjacent the flange a sufficient amount to permit the skidding of the rollers across the width of the flange as the carrier traverses the flange, as will be later explained.

Pursuant to the present invention, the boom carrier 20 is movable on the front ring segment 23 to swing a load through a limited arc. To accomplish this, a horizontal bracket 50 is mounted on the frame element 48 connecting the rear works to the rotatable frame. Two equal-length elongated members or links 52 are provided, each having one end pivotally connected on opposite sides of the carrier 20 with the other end pivotally connected to the respective opposite side of the bracket 50. When the carrier 20 is centered on the track segment 23, the two elongated members 52, the bracket 50 and the carrier 20 substantially form a quadrilateral in the shape of a truncated isosceles triangle. The vertex of this truncated triangle is coincident with the center of rotation or "imaginary" pivot point of the carrier 20 as the carrier passes the center of the track segment (Point O in FIG. 5A). Because the "imaginary" pivot point remains substantially on the vertical axis running through the rearwardmost point of the mast throughout the range of movement of the carrier across the track, the pendant connecting the tip of the mast to the rear works remains, when viewed from above, in its original vertical plane, subjecting the mast to substantially only compressive forces and no side thrust or torsional forces.

In keeping with another aspect of the invention, the bracket 50 can be maintained on the frame element 48 at the same distance from the rotatable frame 25 independent of the distance of the connection point of the mast and pendant from the rotatable frame. The distance between the connection point and the rotating frame may differ, for example, as the length of the mast is increased for scaled-up versions of the crane. As the connection point of the mast moves either forward or rearward with respect to the carrier, so must the center of rotation or imaginary pivot point of the carrier move respectively either rearward or forward. Thus, each side of the bracket is provided with a series of connection points for pivotally receiving one end of each elongated member while the other end of each member remains pivotally connected to the carrier. As the rearwardmost point of the mast is moved rearward or forward, the ends of the elongated members connected to the bracket can pin in further outboard or further inboard connection points respectively to move the center of rotation of the carrier respectively further rearward or forward, maintaining the center of rotation underneath the rearwardmost point of the mast.

Figure 2:
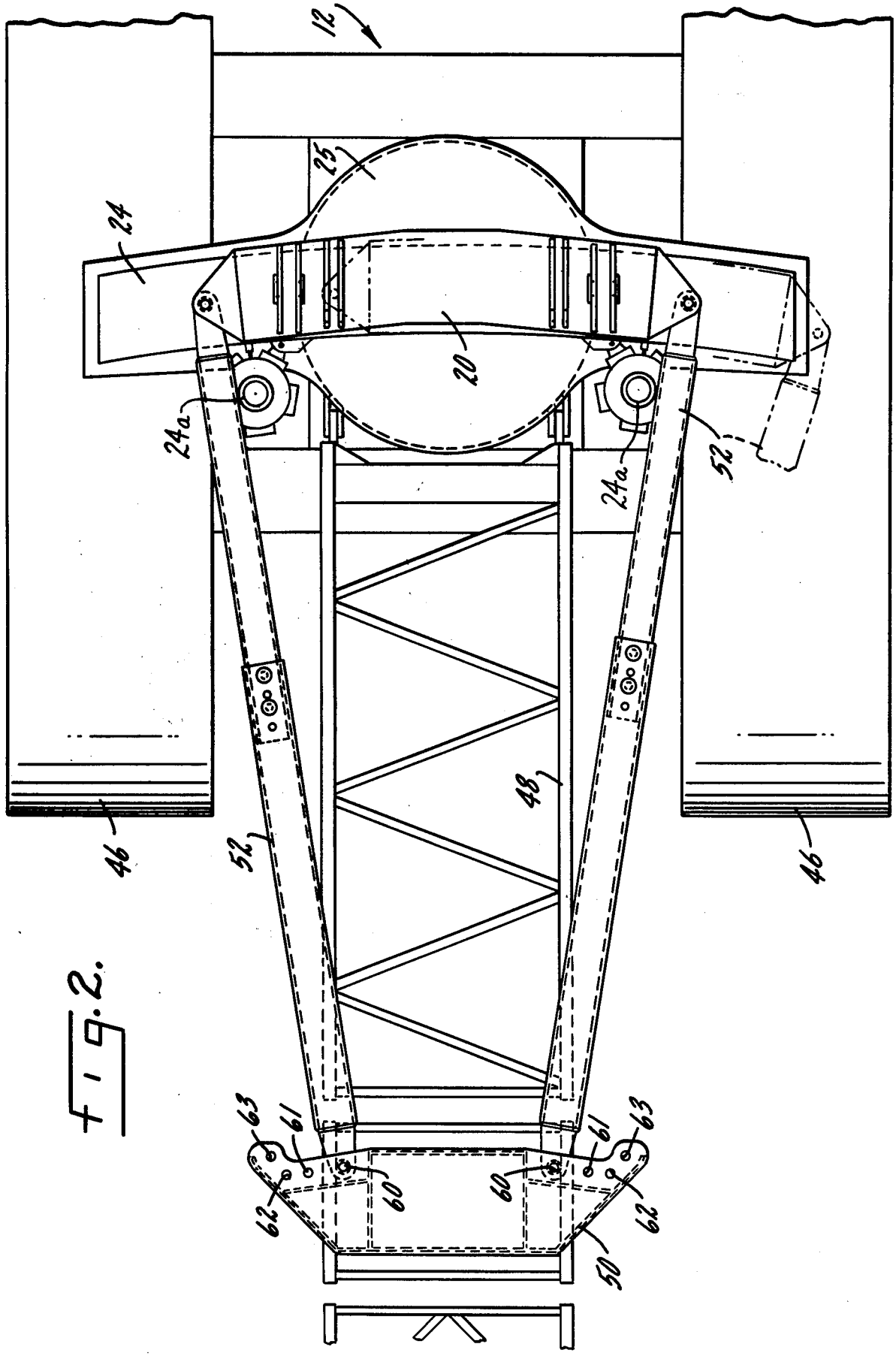
FIG. 2 is a partial top view taken substantially along lines 2—2 in FIG. 1.
Figure 5A:
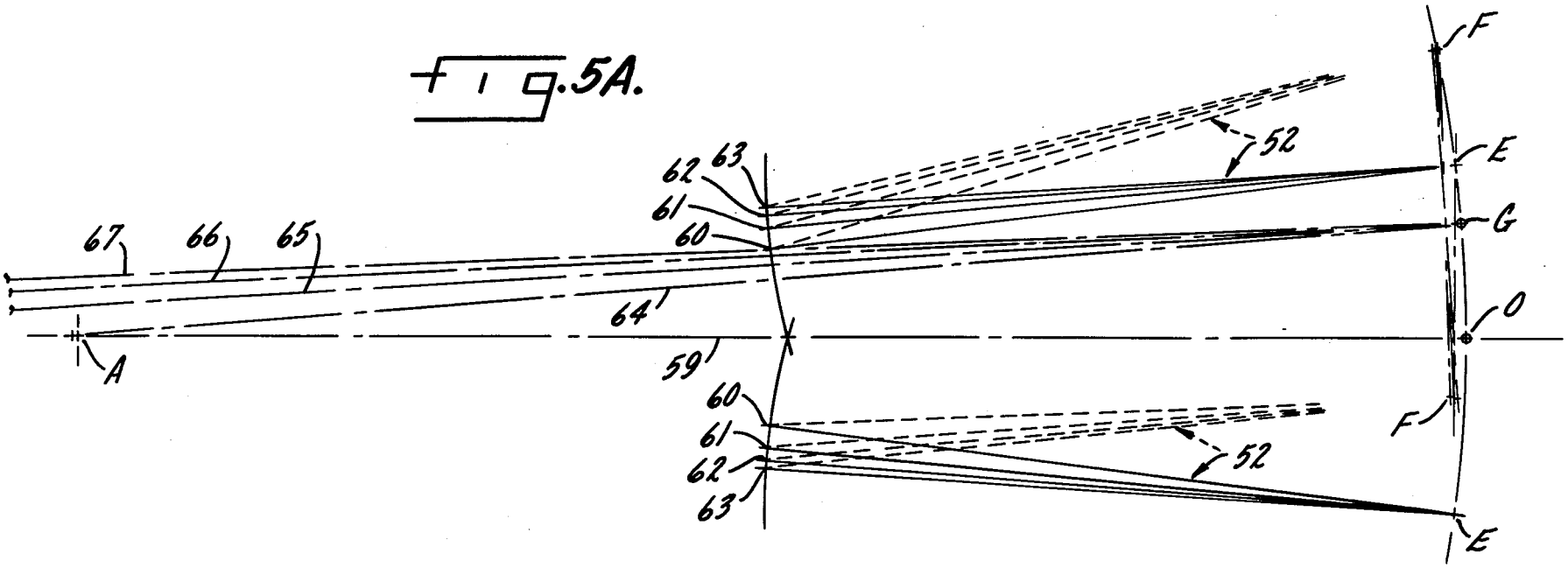
FIGS. 5A and 5B combine to diagram the geometry of the center of rotation of the boom carrier as it traverses the front ring segment for changing mast sizes.
Figure 5B:
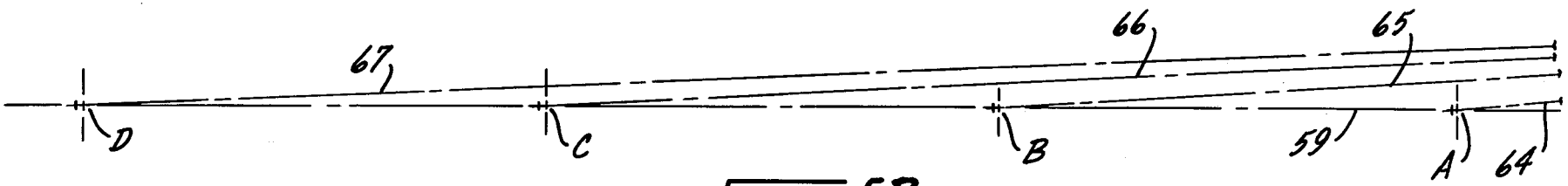

As best seen in FIG. 2, each side of the bracket 50 is provided with a series of four corresponding points, 60, 61, 62 and 63, to which the rearward ends of each link 52 can be pivotally connected. As the rear ends of the links 52 are connected in correspondingly further outboard points on the bracket, the center of rotation of the carrier is moved further rearward. In such a manner, the center of rotation can be adjusted to be coincident with the vertical axis Y (FIG. 1) running through the connection point of the mast and pendant, regardless of the distance of the tip of the mast from the carrier. Referring to FIGS. 5A and 5B, when the links 52 are pinned 60, 61, 62 or 63, the center of rotation is at A, B, C or D, respectively.

In the embodiment shown in FIG. 2, the series of connection points are not on an arc. Thus, as the links are connected to different points on the bracket, the length of the links must be adjusted. To allow for this, each link is composed of two telescoping parts capable of being fixed to the desired length.

Referring again to FIGS. 5A and 5B, O designates the centerpoint of track 23. E represents the positions of the points to which links 52 (shown in solid lines) are pivoted to the carrier 20 when the carrier is centered on the track. F designates the positions of the points to which the links 52 (shown in broken lines) are pivoted to the carrier 20 when the carrier is shifted. G represents the location of the centerpoint of carrier 20 when the carrier is shifted on track 23. (When the carrier 20 is centered on the track, its center is coincident with O, the centerpoint of the track.) 59 represents a line drawn through the centerpoint of carrier 20 and the center of rotation of the carrier when the carrier is centered on the track, while 64, 65, 66, and 67 represent lines drawn through the centerpoint G of the shifted carrier 20 and the centers of rotation A, B, C, and D, respectively, when the links are connected to the bracket 50 at points 60, 61, 62, and 63, respectively.

By way of example, assume that the centers of rotation A, B, C, and D, are 60 feet, 80 feet, 100 feet and 120 feet from O when the links 52 are connected to the bracket 50 at 60, 61, 62, and 63, respectively, the links 52 being 29.9 feet long. If the carrier 20 is shifted five feet to either side of center, i.e., distance between O and G is five feet, the centers of rotation A, B, C, and D, all move backwards from their original positions (i.e., away from O) 2.61 inches, 3.22 inches, 3.60 inches, and 3.85 inches, respectively, and to either side of line 63 by 0.06 inches, 0.07 inches, 0.12 inches, and 0.31 inches, respectively. Clearly, the center of rotation of the carrier will move from its original location by only an insignificant amount when compared to the length of the mast. Thus, if the center of rotation of the carrier 20 and the point on the mast to which the pendant 30 is connected are both coincident with the Y axis (FIG. 1), the pendant 30 will remain in substantially the same vertical plane as the mast and boom throughout the range of motion of the carrier across the track. This means that substantially no side loads will be induced in the mast due to the motion of the carrier. However, if the pendant 30 were to move substantially out of the vertical plane formed by the mast and boom, the mast would be subjected to added torsional forces due to side loading. Because the mast is designed to withstand primarily load-induced compressive forces in a vertical plane, if the side load induces torsional forces on the mast, the maximum load which can be carried by the mast, and thus the crane, is reduced. Such torsionally induced side loads may be encountered in the crane of the above-mentioned parent application due to the mast pivoting about one axis while the counterweight pivots about a second axis. In the instant crane, the rear works remain stationary while the mast pivots about vertical axis substantially coincident with its rearwardmost point. Thus, substantially no side loads are induced in the mast by the pendant during rotation of the mast and boom.

Because the center of rotation does move slightly off the Y axis as the carrier 20 traverses the track 23, the path of the carrier across the track is not a true circular arc and the rollers 21 on which the carrier is mounted skid slightly in a direction transverse to the circular arc. From its center position, as the carrier 20 traverses the track 23, the rollers 21 will slide slightly inward, i.e., toward the rear works. Thus, the flange on the track 23 on which the rollers 21 ride must be wider than the width of the rollers so that the rollers are supported throughout their width as the carrier traverses the track.

From the foregoing, it will be seen that a heavy lift crane is provided which can accurately place a load by swinging the load through a limited arcuate segment, utilizing a standard crane as the rear lift machinery and counterweight support and a front ring segment for supporting the boom and mast and transmitting the load down through a self-propelled transporter assembly into the ground.

While the invention has been described with the pendant being connected to the tip of the mast, it is apparent that the connection point may be at different locations along the mast so long as it is coincident with a vertical axis running through the center of rotation. Other alternatives, modifications and variations will be apparent to those skilled in the art in light of the foregoing description. Accordingly, the invention is intended to embrace all such alternatives, modifications and variations as may fall within the spirit and scope of the appended claims.

What is claimed is:

1. A lift crane with a separated front ring segment and rear works comprising, in combination, rear works including a counterweight supported by a rear transporter assembly; a frame carrying an arcuate horizontal track segment supported by a front transporter assembly; means connecting said rear works to said frame; a carrier mounted for horizontal movement on said track; a forwardly inclined boom and rearwardly inclined mast pivotally mounted for vertical movement on said carrier; means interconnecting the tip of said boom and the rearwardmost point of said mast to said rear works; means for moving said carrier across said track; a horizontal bracket mounted on said connection means between said frame and said rear works; and two equal-length elongated members, each having first and second ends, said first ends being pivotally connected to opposite sides of said carrier and said second ends being pivotally connected to the respective opposite sides of said bracket, said elongated members, bracket and carrier forming a quadrilateral in the shape of a truncated isosceles triangle when said carrier is centered on said track, the imaginary vertex of said truncated triangle being located on a vertical axis running through said rearwardmost point of said mast and constituting the center of rotation of said carrier as it traverses said track so that as said carrier, mast and boom traverse said track, said center of rotation remains substantially on said vertical axis keeping said rearwardmost point of said mast substantially stationary.

2. The lift crane of claim 1 in which said track includes a flange and said carrier is supported on rollers for movement across said flange, the width of said flange being greater than the width of said rollers so that as said carrier traverses said track, said rollers will engage said flange across the entire width of said rollers despite slight deviations from a circular arc of the movement of said rollers across said flange.

3. The lift crane of claim 1 or 2 in which said bracket is mounted on said connecting means the same distance from said frame, said bracket having a series of connection points on each side for pivotally receiving said second end of said elongated members while said first ends remain pivotally connected to said carrier so that as said rearwardmost point of said mast is moved further rearward or further forward said second ends of said elongated members can be pivotally connected to said bracket in corresponding further outboard or further inboard connection points respectively to move said imaginary vertex of said truncated triangle when said carrier is centered on said track respectively further rearward or forward to maintain said vertex on a vertical axis coincident with said rearwardmost point of said mast.

4. The lift crane of claim 1 or claim 2 in which said frame is rotatable with respect to said front transporter assembly.

5. The lift crane of claim 1 or claim 2 in which said rear works is rotatable with respect to said rear transporter assembly.

* * * * *